United States Patent [19]

Martinez

[11] Patent Number: 4,778,302

[45] Date of Patent: Oct. 18, 1988

[54] COMBINATION WRITING INSTRUMENT AND HANDCUFF LOCKING AND UNLOCKING DEVICE

[76] Inventor: Timothy E. Martinez, 1270 Maple St., Beaumont, Calif. 92223

[21] Appl. No.: 70,043

[22] Filed: Jul. 6, 1987

[51] Int. Cl.[4] ..... B43K 29/00; B43K 29/18

[52] U.S. Cl. ..... 401/195; 401/110; 70/456 R

[58] Field of Search ..... 401/195, 52; 70/456 R

[56] References Cited

U.S. PATENT DOCUMENTS 216,031 6/1879 Fairchild ..... 401/52
218,267 8/1879 Hoffman ..... 401/52
1,889,738 5/1932 Nelson ..... 401/52

FOREIGN PATENT DOCUMENTS 0170762 2/1986 European Pat. Off. ..... 401/195

*Primary Examiner*—Richard J. Apley
*Assistant Examiner*—Franklin Gubernick
*Attorney, Agent, or Firm*—Sheldon & Mak

[57] ABSTRACT

A combination writing instrument and handcuff activating device comprises an elongated housing having a writing element and a handcuff locking element axially movable therein. On one end of the housing is a handcuff key. A mechanism is provided so that one or the other of the writing element and the handcuff locking element can be extended from the housing.

7 Claims, 1 Drawing Sheet

COMBINATION WRITING INSTRUMENT AND HANDCUFF LOCKING AND UNLOCKING DEVICE

BACKGROUND

The present invention is directed to pens and other writing instruments combined with a practical tool.

A common problem for law enforcement personnel is that they need to maintain on their person many pieces of equipment. These includes a note pad, night stick, gun, ammunition, writing instrument, handcuffs, handcuff lock, handcuff key, etc. Keeping track of all this different equipment and remembering to carry it all can be burdensome.

Accordingly, there is a need for a device that simplifies the burden on law enforcement personnel of maintaining and keeping track of their equipment requirements.

SUMMARY

The present invention is directed to a device for solving this problem. A device according to the present invention is a combination writing instrument and handcuff activating device. It has an elongated housing having an open end and an opposed end, with an elongated writing element received in and axially movable in the housing. The writing element has an outer writing end such as the tip of a ballpoint pen cartridge.

The housing also contains an elongated handcuff lock which is axially movable in the housing. The lock is generally axially aligned with the writing element and has a locking end adapted for locking handcuffs. The key can be mounted on the end of the housing opposite the open end.

The device also includes a handcuff key mounted on the exterior of the housing and extending therefrom for unlocking handcuffs.

The device also includes means for axially moving the writing element to and from (i) a retracted position where it is retained entirely within the housing, and (ii) an operative position where the writing end of the writing element extends from the open end of the housing. There are also means for axially moving the handcuff lock from (i) a retracted position where it is retained entirely within the housing and (ii) an operative position wherein the locking end of the lock extends from the open end of the housing.

Generally only one of the handcuff lock and the writing element can be in the operative position at any one time. However, both the lock and the writing element can simultaneously be in the retracted position. Preferably the device has a clip on the side wall of the housing for clipping the device to a shirt pocket.

Thus, this single device provides a compact handcuff lock, handcuff key, and a writing instrument.

DRAWINGS

These and other features, aspects, and advantages of the present invention will become better understood with reference to the following description; appended claims, and accompanying drawings where:

DESCRIPTION

Figure 1:
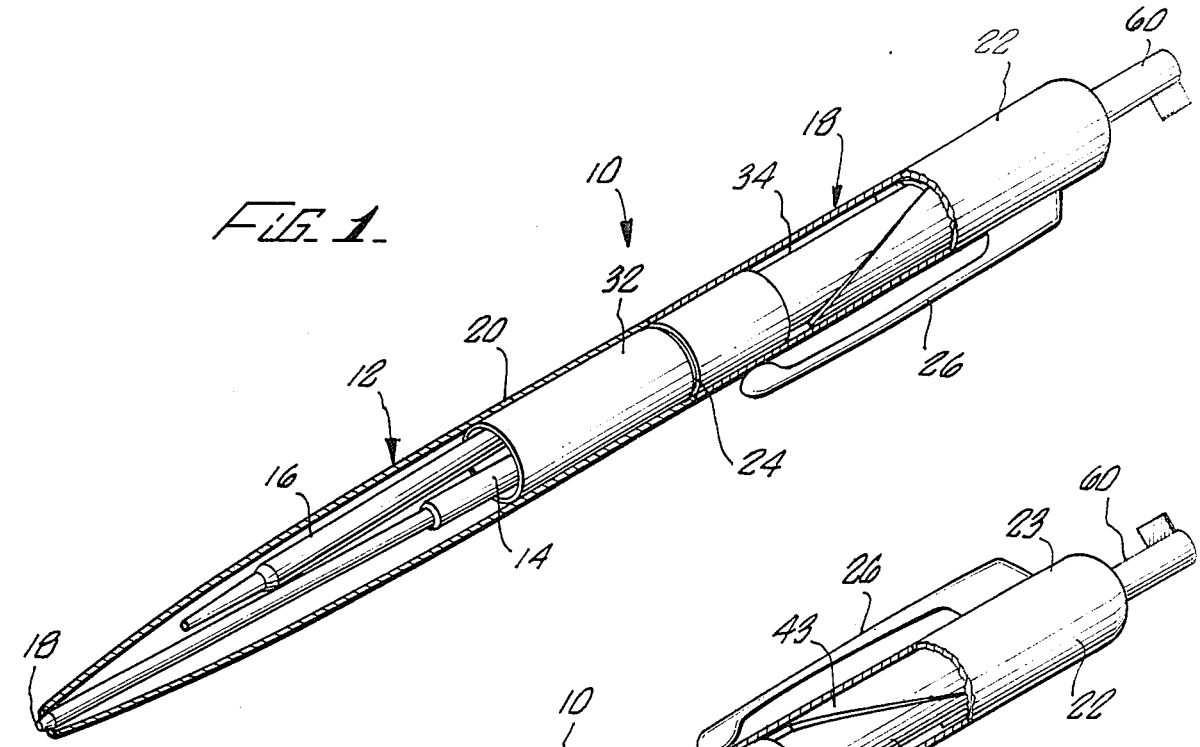
FIG. 1 is a partially broken away perspective view of a combination writing instrument and handcuff activating device according to the present invention wherein the writing element is in its operative position.

With reference to the Figures, a combination writing instrument and handcuff activating device 10 has as its main elements an elongated housing 12, an elongated writing element 14, an elongated handcuff lock 16, and an operating mechanism 18 for moving the writing element 14 and the handcuff lock 16 from and to the respective operative position.

The housing 12 comprises an elongated, hollow barrel 20, an elongated and hollow cap 22 having a side wall 23, and a decorative ring 24 therebetween. Mounted on the exterior of the side wall 23 of the cap 22 is a clip 26 suitable for holding the device 10 securely in a shirt pocket (not shown) or the like.

Within the housing 12 is the writing element 14, which is axially movable in the housing 12. The writing element has an outer writing end 18. As shown in FIG. 1, the writing element 14 can be in an operative position where the writing end 18 extends from an open end 30 of the barrel 20. The writing element 14 also has a retracted position, as shown in FIGS. 2 and 3, where it is retained entirely within the housing 12.

Figure 2:
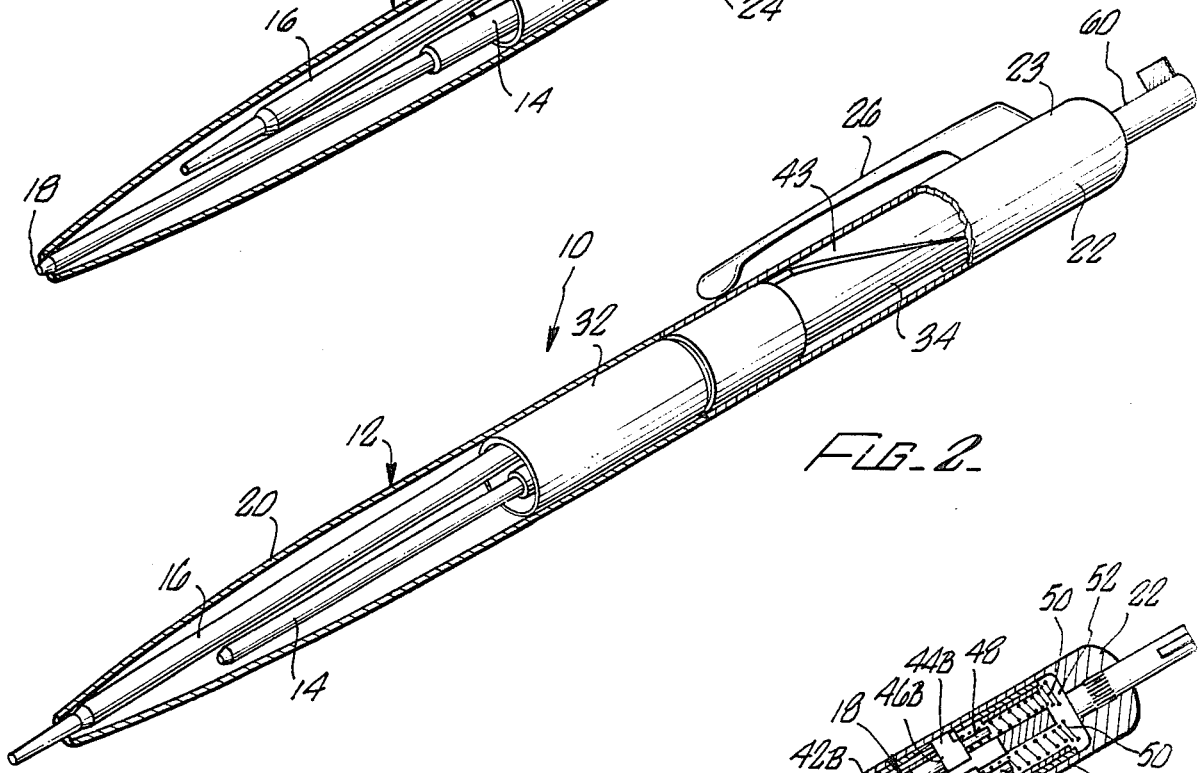
FIG. 2 is a partially broken away perspective view of the device of FIG. 1 wherein the handcuff lock is in its operative position.
Figure 3:
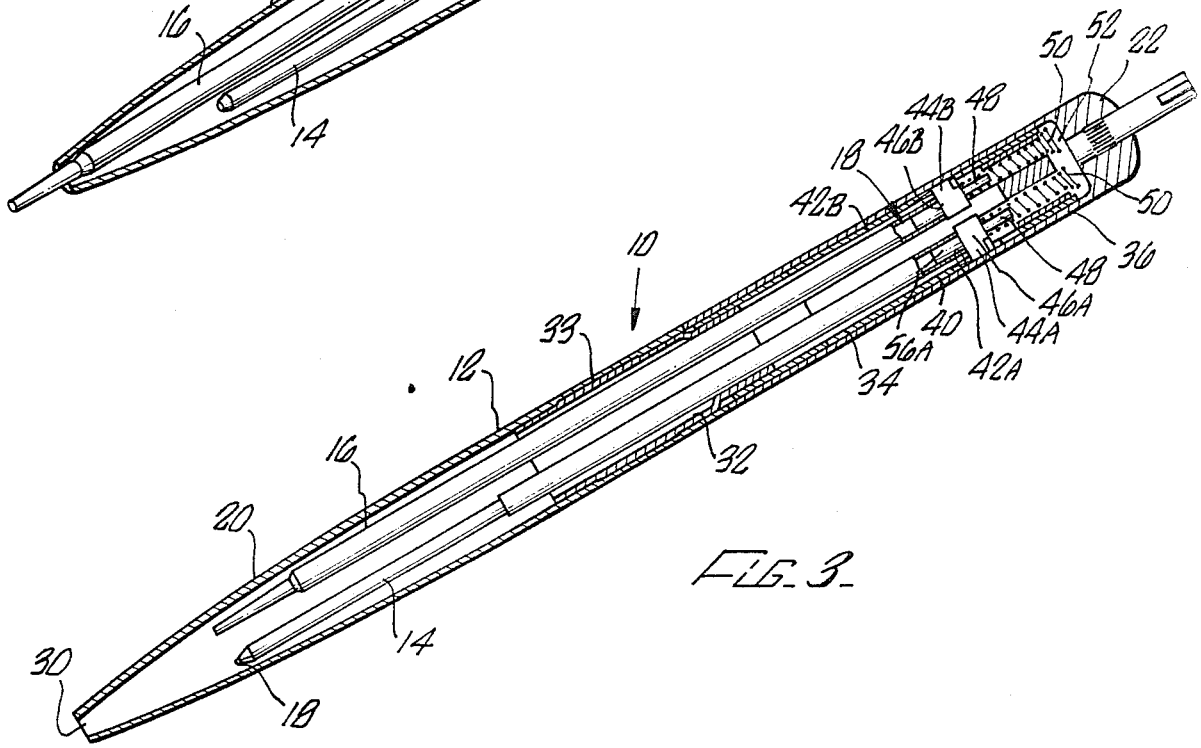
FIG. 3 is a partial longitudinal sectional view of the device of FIG. 1 wherein the writing element and the lock are both in their retracted positions.

Similarly, as shown in FIG. 2, the handcuff lock 16 has an operative position where it extends from the open end 30 of the housing 20, and as shown in FIGS. 1 and 3, a retracted position where it is retained entirely within the housing 12.

The operating mechanism 18 comprises a hollow elongated insert 32 connected to one end of an elongated hollow sleeve 34, and over which is rotatably mounted at the other end a cover 36. The internal diameter of the barrel 20 and the exterior diameter of the insert 32 are sized such that the barrel 20 can tightly fit over the insert 32. The insert 32 can have exterior longitudinal ridges 33 thereon to help maintain this tight fit so that the barrel does not inadvertently slide off during use of the device 10. The ridges 33 also serve to prevent the barrel from rotating relative to the insert 32.

The internal diameter of the decorative ring 24 is sized so that the ring slides completely over the insert 32 and seats up against the lower end of the sleeve 34 in a position between the housing 20 and the cap 22.

The sleeve 34 includes a lower body portion 38 and an upper slotted extension 40. The cover 36 and the body portion 38 of the sleeve 34 have about the same outer diameter while the extension 40 has a smaller diameter. The inner diameter of the cap 22 is sized so that the cap 32 tightly fits over the exterior of the cover 36 and the exterior of the extension 40 of the sleeve 34. Rotation of the cap 22 relative to the barrel 20 results in rotation of the cover 36 of the operating mechanism, while all of the other elements of the operating mechanism do not rotate.

The extension 40 of the sleeve 34 has a pair of diametrically opposed elongated slots 42A and 42B. The rotatable cover 36 includes a spiral shaped cam 43 that extends between the two slots. Extending through each slot 42A and 42B is a corresponding leg 44A, 44B of a T-shaped extender 46A, 46B. A first extender 46A serves to assist in extending and retracting the writing element 14 while a second extender 46B serves to extend and retract the handcuff lock 16. A first arm 48 of each extender is mounted inside a respective helical biasing spring 50. The other end of each biasing spring 50 is retained within a corresponding opening 52 in the top 54 of the cover 36. A second arm 56A of the first extender 40A is slidably mounted inside of the top open end of the writing element 14. The second arm 56B of the second extender 46B similarly is mounted in the top open end of the handcuff lock 16.

With reference to the Figures, rotation of the cap 22 in a counter clockwise direction (viewed from above) causes the cover 36 to likewise rotate relative to the remainder of the device 10. This causes the spiral cam 43 to act upon the first extender 46A causing it to slide downwardly in the first slot 42A forcing the writing element 14 to its extended position (as shown in FIG. 1) against the force of the first biasing spring 50A.

As the cap is rotated clockwise (viewed from above) from the position where the writing element 14 is in its extended operative position, the writing elements returns to its retracted position due to the force of the first biasing spring 50A while the handcuff lock 16 remains in its retracted position. Continued clockwise rotation of the cap 22 results in the cam 43 forcing the second extender 46B downwardly in the second slot 42B, causing the handcuff lock 16 to be forced into its extended operating position as shown in FIG. 2.

The top of the cap 22 has mounted thereon a handcuff key 60 that serves to release the same set of handcuffs that can be locked with the handcuff lock 16.

The clip 26 not only serves to retain the device 10 in a pocket, it also provides leverage for turning the cap 22 for operating the operating mechanism 18, as well as for turning the key 60 in a pair of handcuffs.

The device 10 can be made of any suitable material, including metals and plastics. A conventional ballpoint pen cartridge can be used as the writing element 14.

Thus, the present invention provides a simple and inexpensive device that greatly reduces the burden on law enforcement personnel in carrying their equipment around. A compact and easy to carry device serves as a pen, handcuff lock, and a handcuff key.

Although the present invention has been described in considerable detail with reference to certain preferred versions thereof, other versions are possible. For example the mechanism for retracting and extending the handcuff lock and writing element need not be the one shown in the drawings. For example, a button operating mechanism can be used where the key 60 can be axially movable relative to the housing 12 for moving the handcuff lock 16 and writing element 14 to and from their respective operative position. Moreover, the inside of the barrel 20 and the exterior of the insert 32 can have mating grooves, serrations, splines, and the like to insure that there is no relative rotation between the barrel 20 and the insert 32. Therefore the spirit and scope of the appended claims should not be limited to the preferred versions described herein.

What is claimed is:

1. A combination writing instrument and handcuff activating device comprising:

(a) an elongated housing having an open end;

(b) an elongated writing element received in and axially movable in the housing, the writing element having an outer writing end;

(c) an elongated handcuff locking means received in and axially movable in the housing and generally axially aligned with the writing element, the locking means having a locking end adapted for locking handcuffs;

(d) means for axially moving the writing element to and from (i) a retracted position where it is retained entirely within the housing and (ii) an operative position where the writing end thereof extends from the open end of the housing;

(e) means for axially moving the handcuff locking means from (i) a retracted position where it is retained entirely within the housing and (ii) an operative position wherein the locking end thereof extends from the open end of the housing;

wherein only one of the handcuff locking means and the writing element can be in its respective operative position at any one time, and wherein the locking means and the writing element can simultaneously be in their retracted position; and (f) a handcuff key mounted on the exterior of the housing and extending therefrom, the handcuff key being suitable for unlocking the same handcuffs that can be locked by the handcuff locking means.

2. The device of claim 1 in which the key is mounted on the end of the housing and extends axially therefrom.

3. The device of claim 1 in which the writing element is a cartridge type pen.

4. The device of claim 1 including means for biasing the writing means to its retracted positions.

5. The device of claim 4 including means for biasing the lock to its retracted position.

6. The device of claim 1 including means for biasing the locking means to its retracted position.

7. The device of claim 1 in which the housing has a side wall and including a clip on the side wall for clipping the device to a shirt pocket, the clip providing leverage for operating the key in a pair of handcuffs.

* * * * *